US005422617A

United States Patent [19]

Brown

[11] Patent Number: 5,422,617

[45] Date of Patent: Jun. 6, 1995

[54] MULTIPLE COIL, MULTIPLE ARMATURE SOLENOID

[75] Inventor: Michael H. Brown, Chandler, Ariz.

[73] Assignee: IMC Magnetics Corp., Tempe, Ariz.

[21] Appl. No.: 69,293

[22] Filed: May 28, 1993

[51] Int. Cl.[6] ..... H01F 5/00; H01F 7/00; H01F 7/08

[52] U.S. Cl. ..... 335/267; 335/264; 335/266; 335/268

[58] Field of Search ..... 335/232, 233, 242, 256, 335/259, 264, 265, 266, 267, 268; 310/14, 22, 23, 24, 33, 34, 35

[56] References Cited

U.S. PATENT DOCUMENTS

| | | | |
|---|---|---|---|
| 1,645,628 | 10/1927 | Smith | 335/267 |
| 2,935,663 | 5/1960 | Pollack | 335/264 |
| 3,017,546 | 1/1962 | Bates | 335/259 |
| 3,219,854 | 11/1965 | McLaughlin | 310/14 |
| 3,488,614 | 1/1970 | Macy | 335/267 |
| 3,491,319 | 1/1970 | Cox et al. | 335/259 |
| 3,763,412 | 10/1973 | Detrick et al. | 318/135 |
| 4,081,774 | 3/1978 | Barrett et al. | 335/228 |
| 4,361,309 | 11/1982 | Sogabe | 251/137 |
| 4,546,955 | 10/1985 | Beyer et al. | 251/129.15 |
| 4,697,164 | 9/1987 | Eilertsen | 335/253 |

*Primary Examiner*—Leo P. Picard
*Assistant Examiner*—Raymond M. Barrera
*Attorney, Agent, or Firm*—Poms, Smith, Lande & Rose

[57] ABSTRACT

A multiple coil, multiple armature solenoid is disclosed. The solenoid has; multiple armatures slidably disposed on a common slip shaft, with separate coils disposed about the corresponding armatures. The conductor coils, through magnetic induction, displace the armatures through respective linear strokes along the slip shaft. By varying the stroke length of the various armatures, it is possible to use an armature that travels through a short stroke length to generate kinetic energy that is transferred through the slip shaft to actuate an armature that must travel through a longer stroke length. In this manner, the problem of a high breakaway force associated with a long stroke armature is resolved.

20 Claims, 2 Drawing Sheets

MULTIPLE COIL, MULTIPLE ARMATURE SOLENOID

BACKGROUND OF THE INVENTION

1. Field of the Invention

The present invention relates to an electromagnetically operated device. More precisely, the present invention relates to a multiple coil, multiple armature solenoid.

2. Prior Art and Related Information

A solenoid is generally defined as an electrically energized coil of insulated wire that produces a magnetic field within the coil. In a typical solenoid, the iron core is rod-shaped and the conductor coil is tightly wound around the core. When energized, the magnetized core is attracted to ferromagnetic metals. The magnetic attraction draws the core toward the thing to which it is attracted, hence producing work through such movement. Here, the coil and core move in unison.

In another application, the coil surrounds a moveable iron core that is magnetically pulled to a central position with respect to the coil when the coil is energized by a current passing therethrough. In this case, the magnetic core is commonly known in the art as an armature.

When energized, the coil induces a magnetic force upon the armature, which in turn produces a linear mechanical force. With such a design, a solenoid may either pull or push a load through the field generated by the coil. Hence, solenoids convert electrical power to mechanical power.

Conventional solenoid designs are constrained by numerous parameters. One major constraint is a lack of mechanical output force at the initial armature position, known as the breakaway force. Output force is a function of the distance between the armature's leading face and its corresponding seating surface, known as the stop.

FIG. 1 illustrates this concept. FIG. 1 shows a solenoid comprised of a coil 3, and a moveable armature 2, spaced apart from a stop 1. Distance A defines the stroke of the armature 2 when it is energized. When energized, the leading face 4 of the armature 2 moves in direction B through stroke A until contact with the stop 1.

It has been observed that output force decreases substantially as the armature's stroke distance A increases. Obviously then, this physical constraint amounts to serious performance problems when a long stroke and a high breakaway force are required. Indeed, when a long stroke is necessary, large efficiency losses occur as measured from input of the electrical energy into the coil to the output force from the armature. Therefore, a need presently exists for an efficient solenoid even though the armature must undergo a long stroke and experience a high breakaway force.

SUMMARY OF THE INVENTION

The present invention is directed to a multiple armature, multiple coil solenoid energized by electrical power. In a preferred embodiment, the solenoid comprises a slip shaft on which are slidably mounted armatures magnetically induced for motion via surrounding conductor coils. The armatures move through different stroke distances such that the armature moving through the shortest stroke helps initiate the motion of the armature moving through the next longest stroke. All of the hardware is contained in a single housing.

An output shaft is connected to an armature located at an end of the series of armatures. In fact, the output shaft should preferably be connected to the armature that is set in motion last relative to the other armatures.

By carefully keying the slip shaft to the various armatures, it is possible to cause one armature to move through a short stroke and, during its translation at which time it has high kinetic energy, to transmit through the slip shaft to the next armature which has not yet been set in motion. Through this process, the armature that is set in motion through the shorter stroke benefits from a higher output force which is then transferred to the next armature which must travel through a longer stroke. It is possible then to link up a series of armatures on a single slip shaft to operate collectively thereby conserving kinetic energy and transferring the energy to actuate the armature that must move through the longest stroke.

In short, as the last armature moves through its long stroke, it has benefitted from the kinetic energy transferred to it from the earlier-actuated armatures through the slip shaft. Hence, despite the fact that this armature must undergo a long stroke, and that its breakaway force is necessarily high, the kinetic energy transferred from the earlier-actuated armatures helps offset the large breakaway force. The efficiency gained through conserving the kinetic energy of the series of armatures appears at the output rod connected to the armature last to be actuated.

It is therefore an object of the present invention to provide a solenoid having multiple coils with corresponding multiple armatures, interconnected on a common slip shaft. It is another object of the present invention to utilize the plurality of armatures collectively to compensate for the breakaway force required to actuate specific armatures that must move through a long stroke. It is yet another object of the present invention to provide a solenoid that is highly efficient in converting electrical input energy to mechanical work output. It is still another object of the present invention to provide a solenoid that effectively operates with long armature strokes despite the necessity of substantially large breakaway forces to actuate the armature.

BRIEF DESCRIPTION OF THE DRAWINGS

The objects, features, and advantages of the present invention will be apparent to one skilled in the art from reading the following detailed description in which.

DETAILED DESCRIPTION OF THE INVENTION

The following specification describes a multiple coil, multiple armature solenoid. In the description, specific materials and configurations are set forth in order to provide a more complete understanding of the present invention. But it is understood by those skilled in the art that the present invention can be practiced without those details. In some instances, well known elements are not described precisely so as not to obscure the invention.

Figure 1:
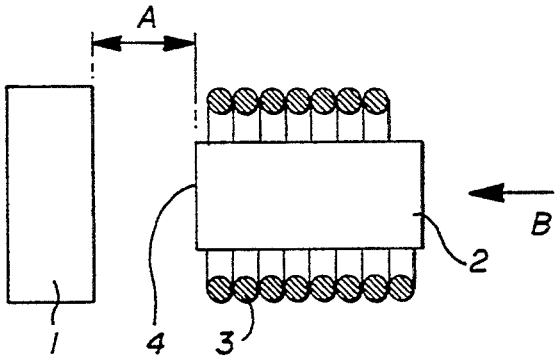
FIG. 1 PRIOR ART
FIG. 1 shows a prior art solenoid.
Figure 2:
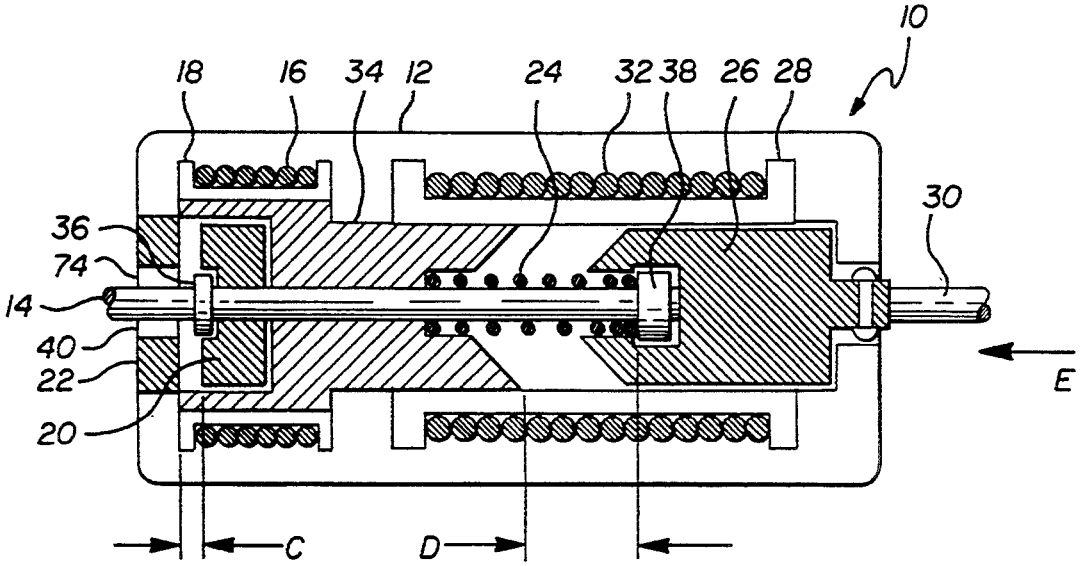
FIG. 2 is a schematic representation of a preferred embodiment solenoid of the present invention.

Generally speaking, the present invention is directed to a solenoid employing multiple coils and multiple armatures. FIG. 2 illustrates a preferred embodiment of the present invention. This embodiment is a unique dual armature, dual coil configuration. The solenoid 10 has a primary armature 20 surrounded by a primary coil 16 and, mounted coaxially therewith, a secondary armature 26 surrounded by a secondary coil 32. Both coils 16, 32 are wound on respective bobbins 18, 28 that generally surround their respective armatures 20, 26. The two armatures 20 and 26 are interconnected by a common slip shaft 14. All of the hardware is enclosed in a housing 12.

The solenoid 10 of FIG. 2 is shown in its de-energized state. Once the primary and secondary coils 16, 32 are energized, however, both the primary armature 20 and secondary armature 26 travel in direction E. The magnetic induction principles involved in drawing the armatures 20, 26 to the respective middle of the coils 16, 32 is well known in the arts and is not discussed in detail here.

Once energized, the primary armature 20 moves through a primary stroke C and its linear displacement is terminated by stop 22. Likewise, the secondary armature 26 when energized moves through secondary stroke D until it engages stop 34. Because the stops 22, 34 and the armatures 20, 26 are made of a ferromagnetic material, the parts are drawn together through magnetic attraction, as is known in the art.

Although each armature is acted upon independently by its own coil, both armatures are connected to a common slip shaft 14. Therefore, the net output force seen at the solenoid's output shaft 30 is the sum of each armature's output force. In this exemplary embodiment, the output shaft 30 is connected to the secondary armature 26. As a result, the total stroke of the output shaft 30 is equal to the stroke D of the secondary armature 26.

As shown in FIG. 2, the primary armature 20 is much closer to its stop 22 when compared to the secondary armature 26 relative to its stop 34. In other words, stroke distance D is greater than stroke distance C. This allows the primary armature 20 to generate a large amount of breakaway force. Because the net stroke of the output shaft 30 is controlled by the secondary armature 26, the solenoid 10 is still capable of long total strokes.

The slip shaft 14 includes a mechanism to link motion of the primary armature 20 to the secondary armature 26. Specifically, in a preferred embodiment, the slip shaft 14 has an optional primary member 36. In the present embodiment, the primary member 36 is simply a ridge. Thus, as the primary armature 20 is energized and it begins its motion in direction E, the armature 20 engages the primary member 36 so that both the primary armature 20 and the slip shaft 14 move in unison or in synchronism.

A secondary member 38 disposed at the opposite end of the slip shaft 14 engages the secondary armature 26 so that the linear force generated by the primary armature 20 is transferred to the secondary armature 26. Obviously, the primary and secondary members 36, 38 can be of other configurations aside from a ridge shown in the drawings. For example, the primary or secondary member 36, 38 may be a key or some other mechanical linkage known in the art. In fact, the slip shaft 14 can be bonded or mechanically locked to the secondary armature 26.

A return spring 24 is disposed on the slip shaft 14 and is biased to separate the secondary armature 26 from the stop 34 when the solenoid 10 is de-energized. Naturally, other means known in the art can be used to return the secondary armature 26 to its start position.

When in operation, the following sequence of events occur inside the solenoid 10. First, a voltage is applied to both coils 16, 32 simultaneously. Second, mechanical force is generated by both armatures 20, 26 through magnetic induction. Third, the primary armature 20, which is slidably mounted on slip shaft 14, moves in direction E and engages the primary member 36. Once this engagement occurs, the primary armature 20 moves the entire slip shaft 14 and everything attached thereto in direction E. Indeed, because the secondary armature 26 is mechanically locked to the slip shaft 14 through the secondary member 38, it is tugged into motion by the primary armature 20.

Fourth, as the primary armature 20 completes its stroke C, the slip shaft 14, secondary armature 26, and output rod 30 continue to travel in direction E. Notably, total net solenoid output force drops sharply at this point because the primary armature 20 is no longer able to pull. Hence, voltage may be removed from the primary coil 16 to conserve energy.

Fifth, as the secondary armature 26 nears its stop 34, output force begins to increase again. Sixth, when the secondary armature 26 comes to rest against its stop 34, voltage may be reduced but not removed from the secondary coil 32. The reason is that less energy is required to hold a load as compared to pulling a load. Lastly, once the voltage on the secondary coil 32 is removed, the compressed return spring 24 forces the secondary armature 26 to its initial position separated from its stop 34.

Figure 3:
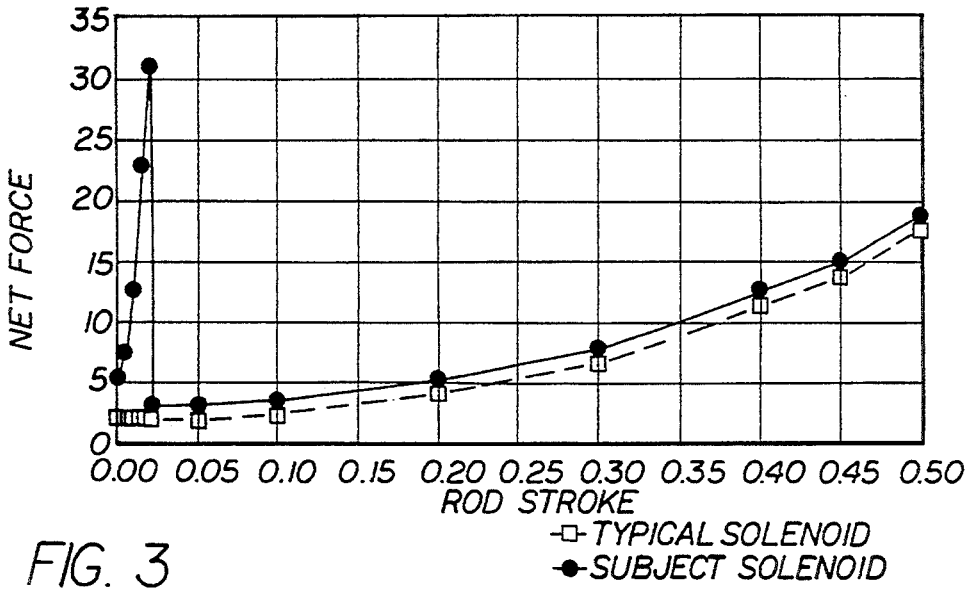
FIG. 3 is a chart plotting output force versus an output rod stroke distance for comparing a conventional solenoid to the present invention solenoid.

FIG. 3 is a performance characteristics curve generated by plotting output rod stroke distance on the abscissa versus net output force of the solenoid on the ordinate. Two curves are shown: the solid curve represents the characteristics of the present invention solenoid; and the dashed curve represents the characteristics of a conventional solenoid. For convenience, the net output force is measured in units of pounds force, while the output rod stroke distance is measured in units of inches.

Based on the empirical information plotted on the chart of FIG. 3, one can see that the present invention solenoid 10 provides an initial tug at the beginning of the stroke of the output shaft 30. This is important because the initial tug helps overcome a high breakaway force that is present when the armature is designed to move through a long stroke. In FIG. 3, the curve for the present invention has a distinctive peak or spike when the output force rod has only moved about 0.025 of an inch.

As compared to a conventional solenoid, the output force is higher initially and after the peak. Looking at the two curves, one sees that the present invention solenoid produces about one pound of greater output force throughout the stroke distances traversed by output rod as compared to a conventional solenoid.

The peak in the output force occurs when the primary armature 20 initially engages the first member 36, which in turn transfers the tug through the slip shaft 14 to the secondary armature 26. This tugging or jerking action of the primary armature 20 on the secondary armature 26 is measurable at the output rod 30, as represented by the peak or spike of FIG. 3. The drop off after the peak in the net output force shown in the curve in FIG. 3 indicates that the primary armature 20 has completed its stroke C and has engaged its stop 22.

Meanwhile, the secondary armature 26 has been set in motion and continues to increase its force output as it is drawn to the middle of the secondary coil 32. As seen in FIG. 2, an opening 74 is provided in the stop 22 and housing 12 so that the slip shaft 14 can slide freely therethrough as it is pushed by the secondary armature 26 when the latter travels through stroke D.

The output force reaches its maximum of just under 20 pounds when the secondary armature 26 completes its stroke D, which corresponds to a distance of approximately 0.50 of an inch. This is shown in FIG. 3.

The exemplary embodiment shown in FIG. 2 can be modified in various ways. Generally, it is preferable that the stops 22, 34 do not move relative to the housing 12, while the slip shaft 14 and armatures 20, 26 do move relative to the housing 12. Furthermore, the slip shaft 14 slides freely through the stops 22 and 34, and the primary armature 20. This provides the full range of motion necessary to accomplish the various objectives of the present invention solenoid.

Clearly, there are other arrangements of the hardware to accomplish the goals of the present invention. For instance, FIG. 4 illustrates an alternative embodiment of the present invention solenoid.

Figure 4:
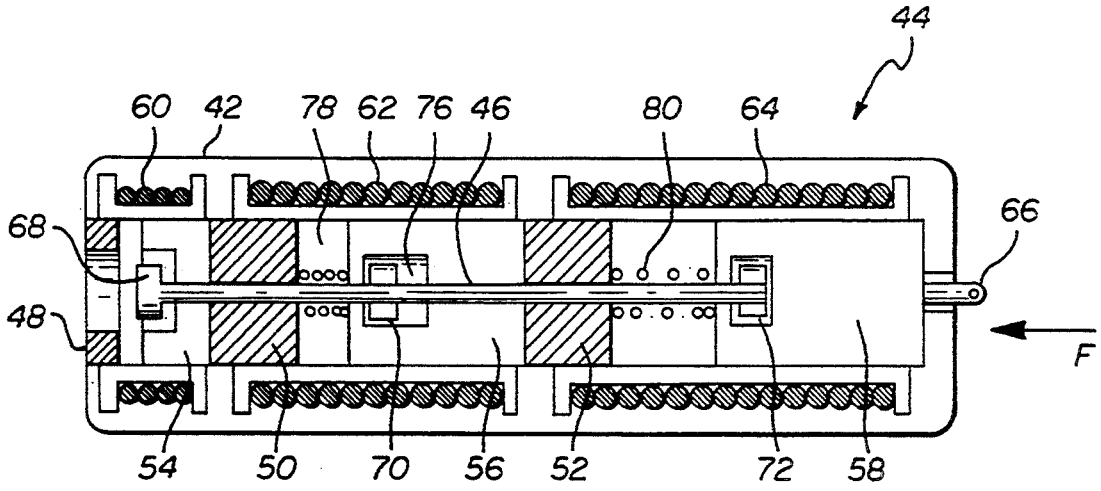
FIG. 4 is a schematic diagram illustrating an alternative embodiment solenoid of the present invention.

Again the solenoid 44 of FIG. 4 is shown schematically for ease of illustration. Here, a first, second, and third armature, 54, 56, 58 are arranged coaxially on a common slip shaft 46. A first, second, and third coil 60, 62, 64 are disposed around the armatures 54, 56, 58. Stops 48, 50, 52 are provided to terminate motion of the respective armatures. An output lug 66 is disposed on the third armature 58. Incidently, an output lug 66 is shown here, but it should be emphasized that any mechanism known in the art can be used to transfer mechanical energy from the solenoid 44. Return springs 78, 80 are provided to separate the armatures from the respective stops when the solenoid 44 is de-energized, as is the state shown here. Furthermore, the armatures and coils and other hardware are conveniently but optionally enclosed in a common housing 42.

When a voltage is applied to the coils 60, 62, 64, the first armature 54 is actuated and moves in direction F. The armature 54 engages a first member 68 located on one end of the slip shaft 46. As the first armature 54 travels through its stroke, it pulls the second and third armatures 56, 58 thus helping each armature overcome its breakaway force. Quickly, the first armature 54 completes its stroke and contacts its stop 48. In the interim, the second armature 56 has traveled partially through its stroke in direction F.

An optional gap 76, located between the second member 70 and an interior surface of the second armature 56, allows some play or slop so that kinetic energy to be transferred from the second armature 56 to the slip shaft 46 can be delayed somewhat. Of course, it is not necessary to include this gap 76. It is also possible to manipulate the timing of when each armature is actuated by locating a gap in front of or behind the second or third member 70, 72.

When the second armature 56 is actuated and fully engaged with the second member 70, the former's kinetic energy is transferred to the slip shaft 46 and ultimately to the third armature 58. Generally speaking, then, the third armature 58 experiences two separate tugs. If the output force as measured at the output lug 66 is plotted on a chart against its linear displacement or stroke distance, there would be two peaks rather than one peak as shown in FIG. 3.

Although not shown, it is therefore possible to serially link a plurality of armatures, with corresponding coils, so that the last armature experiences numerous tugs. In such an alternative embodiment, the output force when plotted against the stroke distance as in FIG. 3 would generate a characteristic curve much flatter than the exponential-like curve shown in FIG. 3. In other words, there would be many more peaks or spikes spread along the output stroke distance axis as each armature contributes its tug.

In the drawings, the armatures have been shown with different masses. This was done because the smaller massed armatures are used to overcome the breakaway force or inertia of the large-massed armature, which must also travel through a long stroke. With a larger mass armature, it is possible to take advantage of a stronger magnetic field produced by the coil and thereby ultimately producing a larger output force.

The present invention solenoid uses conventional materials for construction. For example, the coils should be made from a conductive material such as copper of an adequate gage as determined by application. The armatures and stops should be made from a ferromagnetic material. Other materials known in the art can be substituted and would be within the scope the present invention. To be sure, insofar as the present invention has been described in connection with specific embodiments, it is evident that numerous alternatives, modifications, variations, and uses will be apparent to those skilled in the art in light of the foregoing description.

What is claimed is:

1. A solenoid energized by electrical power comprising:

a slip shaft having a primary member and a secondary member;

a primary armature disposed on the slip shaft, wherein the primary member engages the primary armature for synchronous motion with the slip shaft through a primary stroke;

a primary coil generally circumscribing the primary armature, energized by the electrical power;

a secondary armature disposed on the slip shaft, wherein the secondary member engages the secondary armature for synchronous motion with the slip shaft through the primary stroke;

a secondary coil generally circumscribing the secondary armature, energized by the electrical power; and a housing containing the solenoid.

2. The solenoid of claim 1, wherein the secondary armature moves through a secondary stroke, and wherein the secondary stroke is a greater displacement than the primary stroke.

3. The solenoid of claim 2, wherein the solenoid further comprises a stop disposed on the slip shaft between the primary armature and the secondary armature.

4. The solenoid of claim 3, wherein a spring is disposed on the slip shaft between the stop and the secondary armature.

5. A solenoid energized by electrical power, comprising:

a shaft;

a primary armature disposed on the shaft;

primary means for electromagnetically inducing motion of the primary armature, energized by the electrical power, disposed about the primary armature;

a secondary armature disposed on the shaft;

secondary means for electromagnetically inducing motion of the secondary armature, energized by the electrical power, disposed about the secondary armature;

a primary member disposed on the shaft, engaging the primary armature for synchronous motion therewith through a primary stroke;

a secondary member disposed on the shaft, engaging the secondary armature for synchronous motion therewith through the primary stroke, disposed on the shaft; and a housing containing the solenoid;

whereby the primary armature moves through the primary stroke and translates motion of the primary stroke to the secondary armature through the primary member, the shaft, and the secondary member.

6. The solenoid according to claim 5, wherein the secondary armature moves through a secondary stroke, and wherein the secondary member engages the secondary armature only through the primary stroke.

7. The solenoid according to claim 6, wherein the solenoid further comprises a stop, disposed on the shaft, for engaging the secondary armature.

8. The solenoid of claim 7, wherein the solenoid further comprises a means for biasing apart the stop and the secondary armature, disposed on the shaft between the stop and the secondary armature.

9. The solenoid of claim 8, wherein the primary stroke is a smaller distance than the secondary stroke.

10. The solenoid of claim 9, wherein the secondary means includes a conductor coil disposed on a bobbin generally circumscribing the secondary armature, and the primary means includes a conductor coil disposed on a bobbin generally circumscribing the primary armature.

11. The solenoid of claim 10, wherein the means for biasing apart includes a spring.

12. The solenoid of claim 11, wherein the primary armature and the secondary armature include a ferromagnetic material.

13. The solenoid of claim 12, wherein the solenoid further comprises an output shaft connected to the secondary armature.

14. The solenoid of claim 13, wherein secondary armature includes a greater mass than the primary armature.

15. A solenoid energized by electrical power comprising:

a shaft including a first member, a second member, and a third member;

a first armature disposed on the shaft, wherein the first armature engages the first member for synchronous motion with the shaft through a first stroke;

a first coil generally circumscribing the first armature, energized by the electrical power;

a second armature disposed on the shaft, wherein the second member engages the second armature for synchronous motion with the shaft through the first stroke, and wherein the second armature moves through a second stroke and engages the second member for synchronous motion with the shaft;

a second coil generally circumscribing the second armature, energized by the electrical power;

a third armature disposed on the shaft, wherein the third member engages the third armature for synchronous motion with the shaft, and wherein the third armature moves through a third stroke and engages the third member for synchronous motion with the shaft;

a third coil generally circumscribing the third armature; and a housing containing the solenoid.

16. The solenoid of claim 15, wherein the shaft further comprises a fourth member, and the solenoid further comprises a fourth armature disposed on the shaft, wherein the fourth member engages the fourth armature for synchronous motion with the shaft, and wherein the fourth armature moves through a fourth stroke and engages the fourth member for synchronous motion with the shaft.

17. The solenoid of claim 16, wherein the solenoid further comprises an output shaft attached to the fourth armature.

18. The solenoid of claim 17, wherein the first, second, and third armatures include a ferromagnetic material, and the first, second, and third coils include a conductive material.

19. The solenoid of claim 18, wherein a plurality of stops are disposed on the shaft for engagement with the first, second, third and fourth armatures.

20. The solenoid of claim 19, wherein the respective masses of the first, second, third, and fourth armatures increase.

* * * * *